United States Patent [19]

Berfield et al.

[11] Patent Number: 4,797,072

[45] Date of Patent: Jan. 10, 1989

[54] PORTABLE ELECTRIC BLOWER

[75] Inventors: Robert C. Berfield, Jersey Shore; Ronald F. Meland, Muncy; Craig A. Seasholtz, Avis, all of Pa.

[73] Assignee: Shop-Vac Corporation, Williamsport, Pa.

[21] Appl. No.: 64,768

[22] Filed: Jun. 19, 1987

[51] Int. Cl.[4] ..... F04B 35/04; A47L 5/22

[52] U.S. Cl. ..... 417/423.2; 15/326; 15/353

[58] Field of Search ..... 417/312, 423 A; 15/326, 15/353

[56] References Cited

U.S. PATENT DOCUMENTS

| | | | |
|---|---|---|---|
| 1,320,224 | 10/1919 | Garman | 417/312 |
| 1,991,859 | 2/1935 | Lofgren | 417/423 A |
| 2,034,373 | 3/1936 | Bilde | 417/423 A |
| 2,114,780 | 4/1938 | Juelson | 417/423 A |
| 2,886,127 | 5/1959 | Brock | 417/423 A |
| 3,220,638 | 11/1965 | Petersen | 417/423 A |
| 3,906,584 | 9/1975 | Hult | 417/423 X |
| 4,088,424 | 5/1978 | Hyatt et al. | 417/423 A |
| 4,111,615 | 9/1978 | Watanabe | 417/423 A |
| 4,325,163 | 4/1982 | Mattson et al. . | |
| 4,356,591 | 11/1982 | Lude | 15/326 |
| 4,512,713 | 4/1985 | Berfield | 15/326 X |
| 4,538,971 | 9/1985 | Miller et al. | 417/423 A |

*Primary Examiner*—William L. Freeh

*Attorney, Agent, or Firm*—Ostrolenk, Faber, Gerb & Soffen

[57] ABSTRACT

The invention concerns an air blower including a centrifugal fan which is driven by an electric motor. The blower has a two-part blower housing comprising an upper housing which encloses the motor beneath the motor cap and a lower housing. The centrifugal fan is disposed in the chamber between the upper and lower housings. The plenum around the fan leads to an outlet from the blower. An intake shield extends across and blocks undesired entrance of objects into the inlet opening in the bottom of the lower housing. The blower may be seated on a lid across an opening in it. An adapter in the lid receives the intake shield and has its own air inlet to the blower. The orientation of the blower with respect to the lid is rotatable. Cooperating flanges on the blower and the adapter hold the blower to the lid at two rotative locations and a button latch arrangement latches the blower at each of the two arrangements. Between the two latched orientations, the blower may be lifted free of the lid.

9 Claims, 12 Drawing Sheets

FIG. 11.
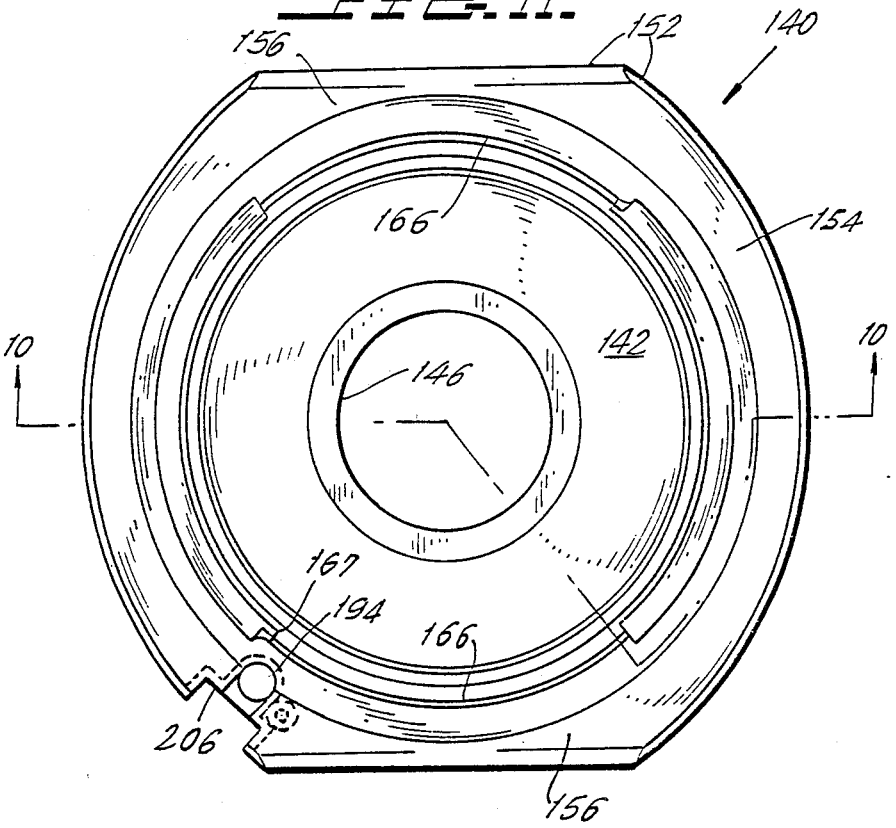
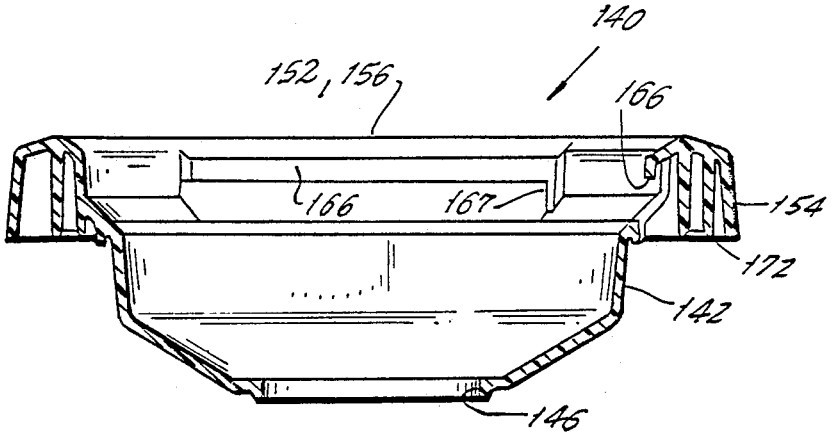
FIG. 10.

FIG. 12.
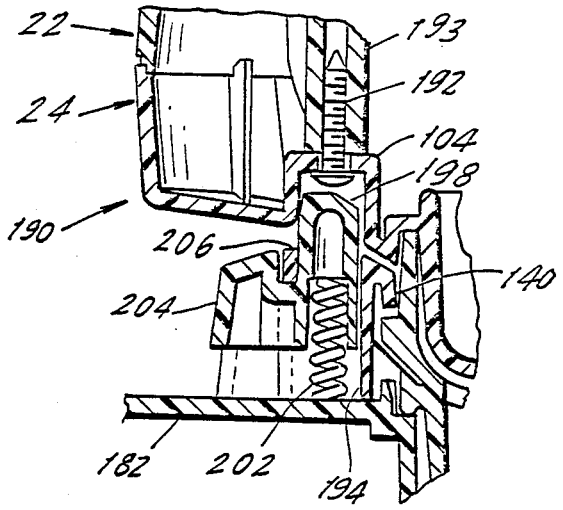
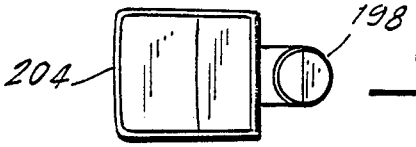
FIG. 14.
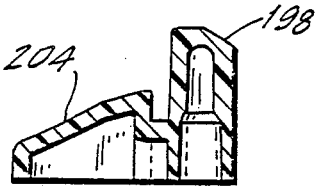
FIG. 13.

FIG. 17
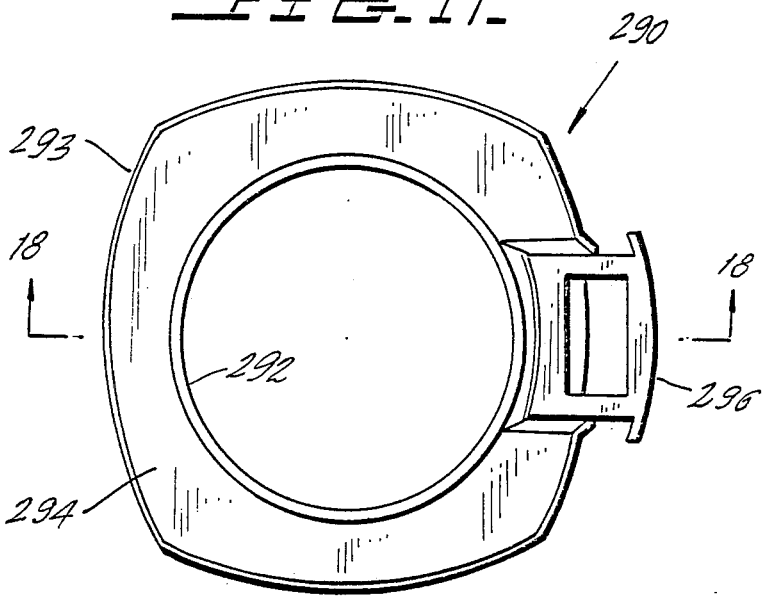
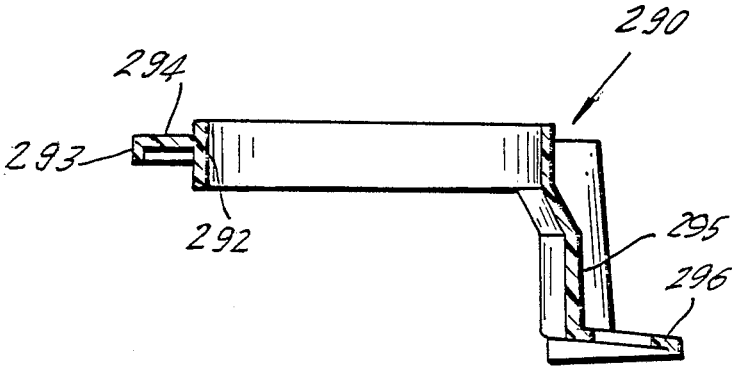
FIG. 18

PORTABLE ELECTRIC BLOWER

BACKGROUND OF THE INVENTION

The present invention relates to a portable air blower, particularly an electric blower, and to such a blower which may be installed on the collecting tank of and also may serve as the blow motor of a vacuum cleaner, if desired.

A portable blower has a blower housing with an impeller or fan in it that draws air into the housing and blows it through a directed outlet from the housing. One such blower is shown in U.S. Pat. No. 4,325,163. Since the blower housing has an inlet, and suction necessarily develops at the inlet, the blower may be used to draw a vacuum, as with a vacuum cleaner, and may additionally be installed on the collecting tank of a vacuum cleaner for generating the needed vacuum.

Portability, light weight and simplicity are all desirable attributes of a portable blower. Further, the blower may rest against or be seated upon a surface, and one or the other of its ends may contact the surface or contact the body or the clothing of a person using it. The intakes into the blower should not become blocked or clogged through contacting the surfaces or the body or clothing of the user. Further, there must be security against a user accidentally inserting his fingers and against other objects entering the blower. Various grills are known for this purpose. Finally, if the blower is installed on a support, such as the tank of a vacuum cleaner, or the like, easy attachment and detachment of the blower from the support is desirable and also ready adjustment of its orientations is desirable.

SUMMARY OF THE INVENTION

Accordingly, it is an object of the present invention to provide an improved blower which protects the user against inadvertently inserting any objects into the blower.

Another object of the invention is to prevent any surface or materials against which the blower is rested from blocking entrance of air into the blower.

Another object of the invention is to enable easy attachment of the blower to and removal of it from a support, such as a tank.

Another object of the invention is to separate the main airflow pathway through the blower from another airflow pathway past the motor which operates the blower.

Another object of the invention is to enable easy reorientation of the direction of the blower with respect to the surface or tank on which it is positioned.

According to the invention, the air blower has an external housing which is comprised of a blower housing and a motor cap above the blower housing. The blower housing, in turn, is divived into an upper blower housing and a lower blower housing. The blow motor for driving the impeller or fan of the blower is disposed between the upper blower housing and the motor cap, and that space may define a cooling air pathway for air passing through the blower motor. The bottom of the upper housing provides an air seal between the upper housing and the lower housing. In the sealed space between the bottom of the upper and the bottom of the lower housing is disposed the fan for moving air into an inlet in the bottom of the lower housing and out of an outlet from the blower housing. Preferably, the fan is a centrifugal fan. The inlet to the blower housing is along the axis of the centrifugal fan and the outlet from that housing is centrifugally out the periphery of the fan to a chamber around the periphery of the fan and beneath the bottom of the upper blower housing. An outlet at one side of the blower housing is defined by a respective tubular section from each of the upper and lower blower housings which together define a tubular outlet that is encircled and completed by a ferrule.

An intake shield extends across the inlet to the blower housing and is spaced from the inlet. Air passage means through the intake shield permit air to enter the blower housing inlet. Those air passage means are preferably in the form of narrow width grill openings that prevent fingers or foreign articles from being inserted through the grill, and the grill blocks passage of inserted articles to the blower housing inlet which is spaced away from it. When the blower is separated from its support, the intake shield bottom surface may serve as a base which rests on a surface or which rests against the body or clothing of the operator. The air passage means are preferably off the base or bottom surface of the intake shield so as not to be blocked by the surface on which the blower is resting or by the body or clothing of the person using the blower.

The motor cap over the motor supports the top end of the motor. The bottom of the upper blower housing supports the other end of the motor in the chamber.

The blower is intended to be used either separate from a support or may be disposed on a support, which may be the lid of a tank, with the inlet into the blower communicating into the open end of the tank. That surface, for example, may be the lid of the tank of an electric vacuum cleaner. The intake shield should rest around the periphery of the opening in the surface. To this end, an additional adapter may be disposed around the periphery of the opening in the surface. The adapter is cup shaped for receiving the intake shield. The adapter includes a bottom that extends past the underside of the intake shield and is spaced from it. The adapter has its own inlet opening, which communicates into the space between the intake shield and the adapter.

The inlet openings through the adapter, the intake shield, and the inlet to the blower housing are not aligned openings, so that insertion of fingers or foreign articles all the way from the adapter into the inlet housing is prevented and travel of large articles along such pathway is also prohibited.

The surfaces at the periphery of the opening in the lid or support surface, where the adapter and the support surface contact, at the contact between the adapter and the intake shield and at the contact between the intake shield and the blower housing all are or become generally air sealed which prevents air leakage at those contacting regions when the motor is operating and suction force is applied through the inlet to the motor housing.

When the blower is installed on the surface or in the adapter in the opening in a lid, for user convenience, it may be useful to have the blower facing one or another direction, e.g. opposite directions. Means are provided for connecting the blower to the surface, that is, to the adapter at the surface, and for latching the blower at any of more than one rotative orientation, which permits the blower to blow in different directions. This assures that the blower will hold together with the adapter in the housing when they are at the different respective orientations. The latching means are releasable for permitting reorientation of the blower with respect to the housing and also for permitting rotation of the blower to a position which permits the blower to be freed from the adapter and the support surface of a lid to which the adapter has been attached. The latching means comprises a spring biased button on the surface or lid to which the blower is attached and which projects into a selected one of a plurality of recesses defined in the blower housing. When the button is received in one of those selected recesses, the means for securing the blower housing to the adapter are holding them together. When the latching means is released to unlatch the blower housing and support surface, the blower housing may be rotated to a position permitting their separation.

For holding the blower housing and the adapter or the support surface, such as the lid, together, respective overhanging flanges may be defined both in the blower housing, on the one hand, and in the adapter or support surface, on the other hand, with the flanges being so shaped and placed that with the blower in one of the selected or latched orientations with respect to the support surface, the flanges overhang one another and prevent separation of the blower from the housing. The flanges are further so shaped and placed that with the blower rotated to a different orientation with respect to the support or lid other than a latched orientation, the flanges no longer interfere so that the blower may be lifted free of the support. The flanges may be arcuate in shape, with the arcs being of a length and so disposed as to permit the selective prohibition against separation and to permit the separation, depending upon the rotative orientation of the blower with respect to the support.

There are blocking means between the blower and the support surface that permit only clockwise rotation of the blower with respect to the surface to bring the flanges into engagement and counterclockwise rotation or disengaging the flanges. In particular, these blocking means are on the intake shield of the blower and on the flange on the adapter.

Various embodiments of the blower of the invention are illustrated. Depending upon the size of the fan, and thus of the CFM of its airflow, the airflow pathway from the fan to the blower outlet may be more or less tortuous. The airflow off a larger size centrifugal fan is nearly at about the height of the outlet and is not blocked against moving straight out to the outlet, whereas with the airflow from a smaller size fan, the lower housing is shaped for blocking movement of air straight out from the centrifugal fan and instead redirects the air upwardly and then outwardly toward the blower outlet.

In some embodiments, the motor is encased within its own housing inside the motor cap and blower housing. In other embodiments, the motor is not so encased. In the latter situation, there are additional elements within the motor cap which provide support to the motor and to the switch for operating the motor which give ready access to the motor parts within when the motor cap is removed.

Other objects and features of the present invention will become apparent from the following description of preferred embodiments of the present invention considered in conjunction with the accompanying drawings.

BRIEF DESCRIPTION OF THE DRAWINGS

FIG. 10 is a side cross sectional view of an adapter for installation between the blower and the lid of a collecting tank, and viewed along the pathway indicated by the lines 10 in FIG. 11.

FIG. 11 is a top view of the adapter for the blower.

FIG. 12 is a fragmentary side cross sectional view of the blower showing a releasable latching arrangement for the blower.

FIG. 13 is a side cross sectional view of the operating button for the latching arrangement.

FIG. 14 is a top view of that button.

FIG. 17 is a top view of a baffle for the motor in the third embodiment of the invention.

FIG. 18 is a side cross sectional view along the line indicated by arrows 18 in FIG. 17.

DESCRIPTION OF THE PREFERRED EMBODIMENTS

Figure 1:
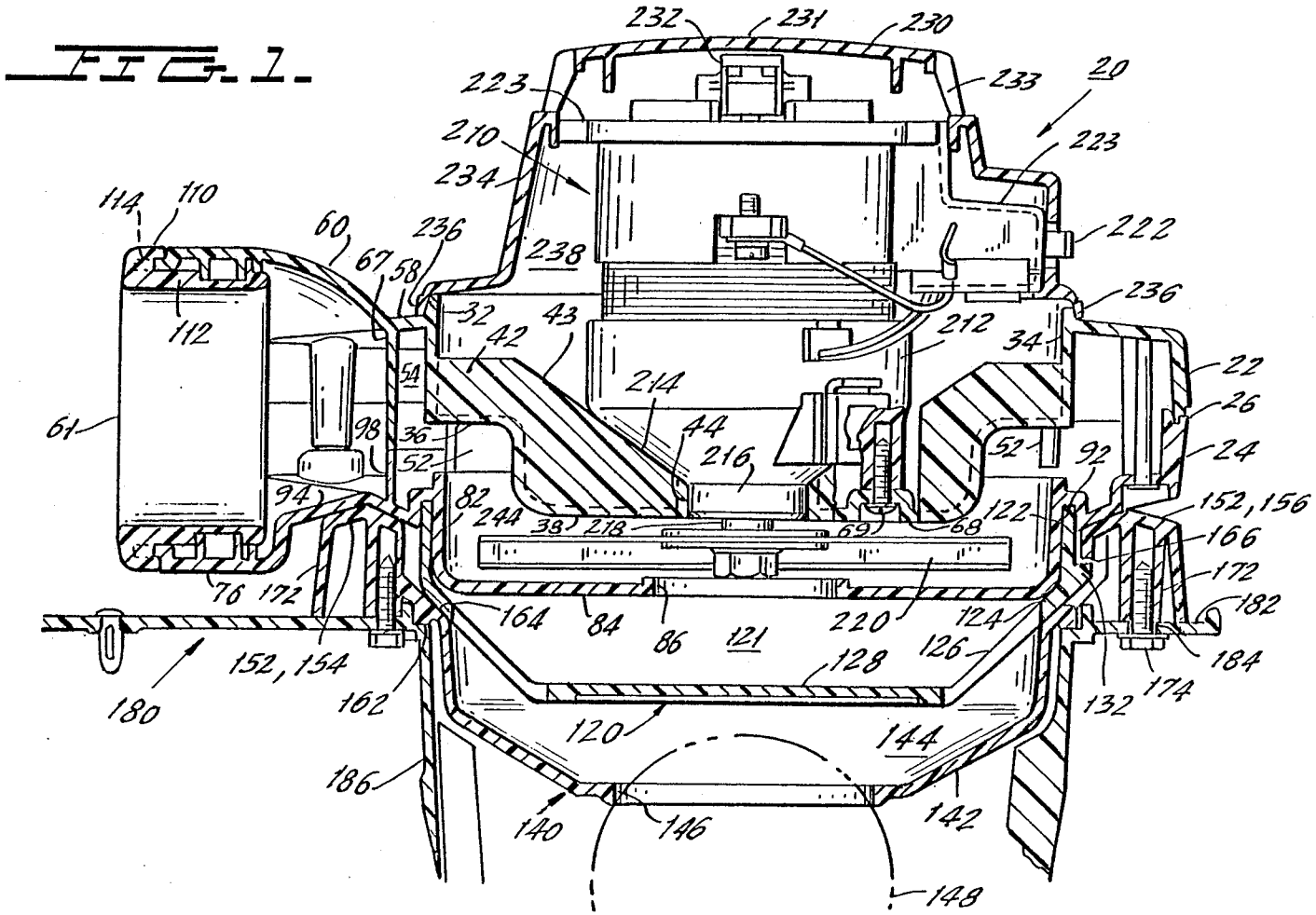
FIG. 1 is an elevational cross sectional view of a blower according to a first embodiment of the present invention.

The portable blower 20 of the present invention is an electric motor operated blower. The blower may be the suction head from a tank type electric vacuum cleaner as shown in FIG. 1, wherein the suction head is separated from the tank and serves as the blower 20. However, the invention is not limited to a blower which may be installed on a collection tank of a tank type vacuum cleaner.

Figure 2:
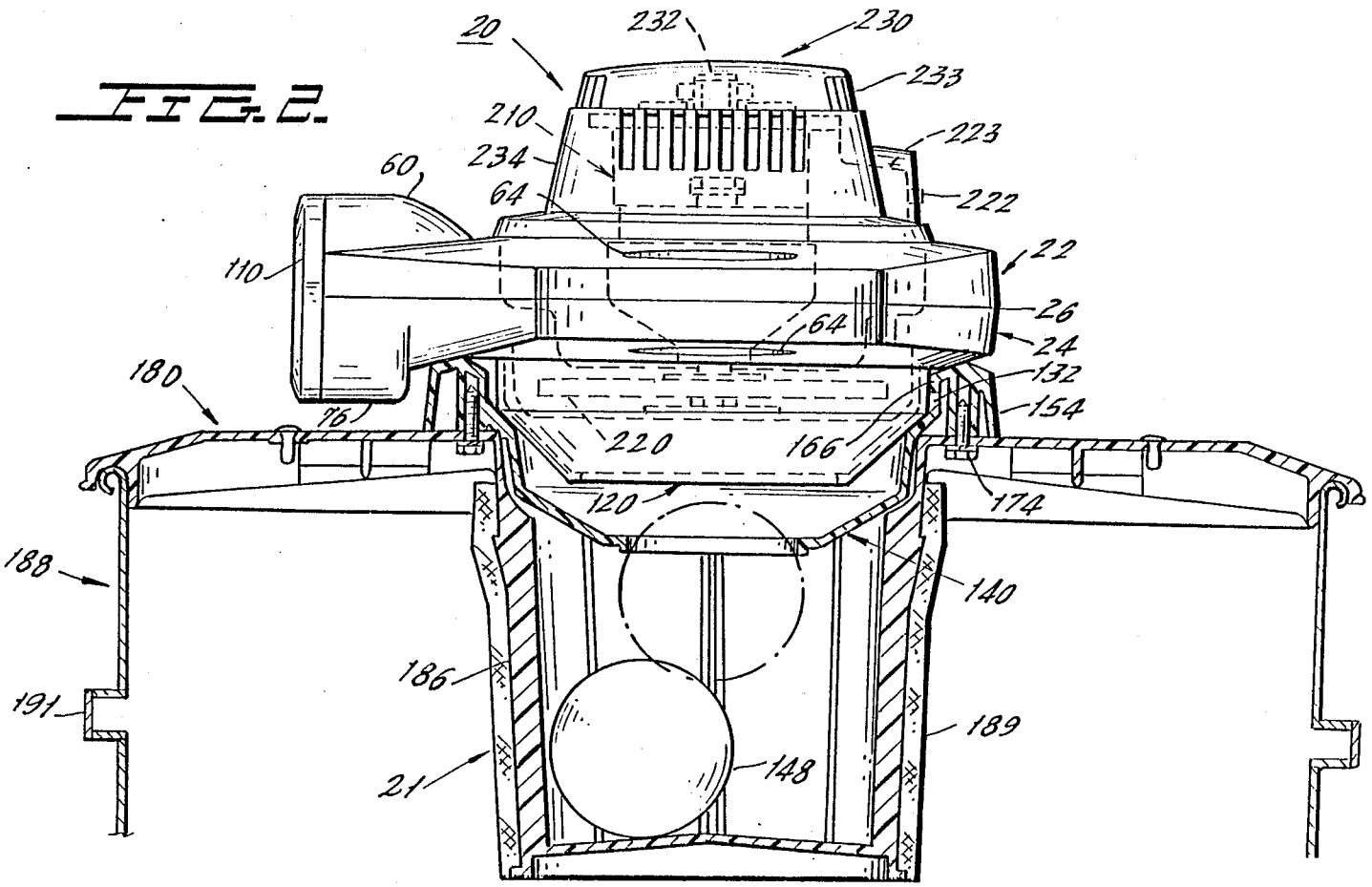
FIG. 2 is an elevational view, partly in cross section, of the first blower embodiment installed on a collecting tank.
Figure 3:
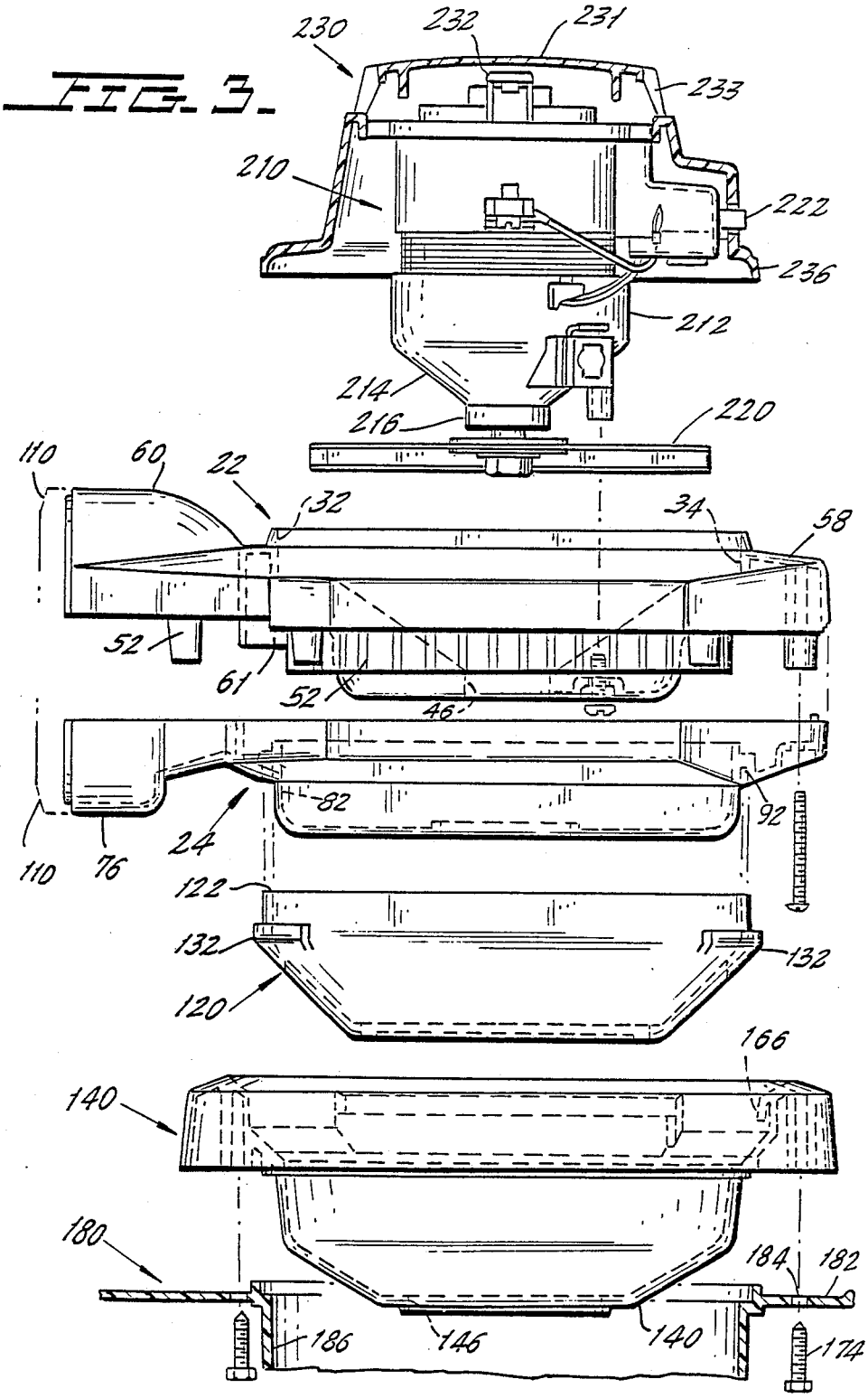
FIG. 3 is an exploded, partially cross section, side elevational view of the first blower embodiment.
Figure 4:
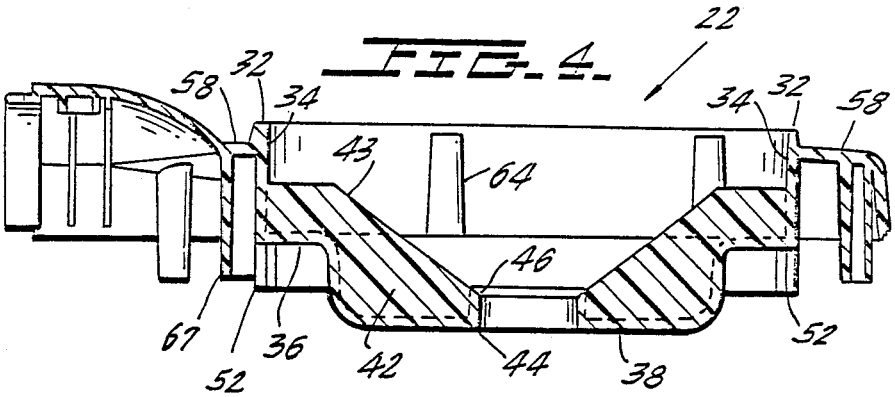
FIG. 4 is a side cross sectional view of an upper blower housing for the blower, viewed along the line 4—4 in FIG. 5.
Figure 5:
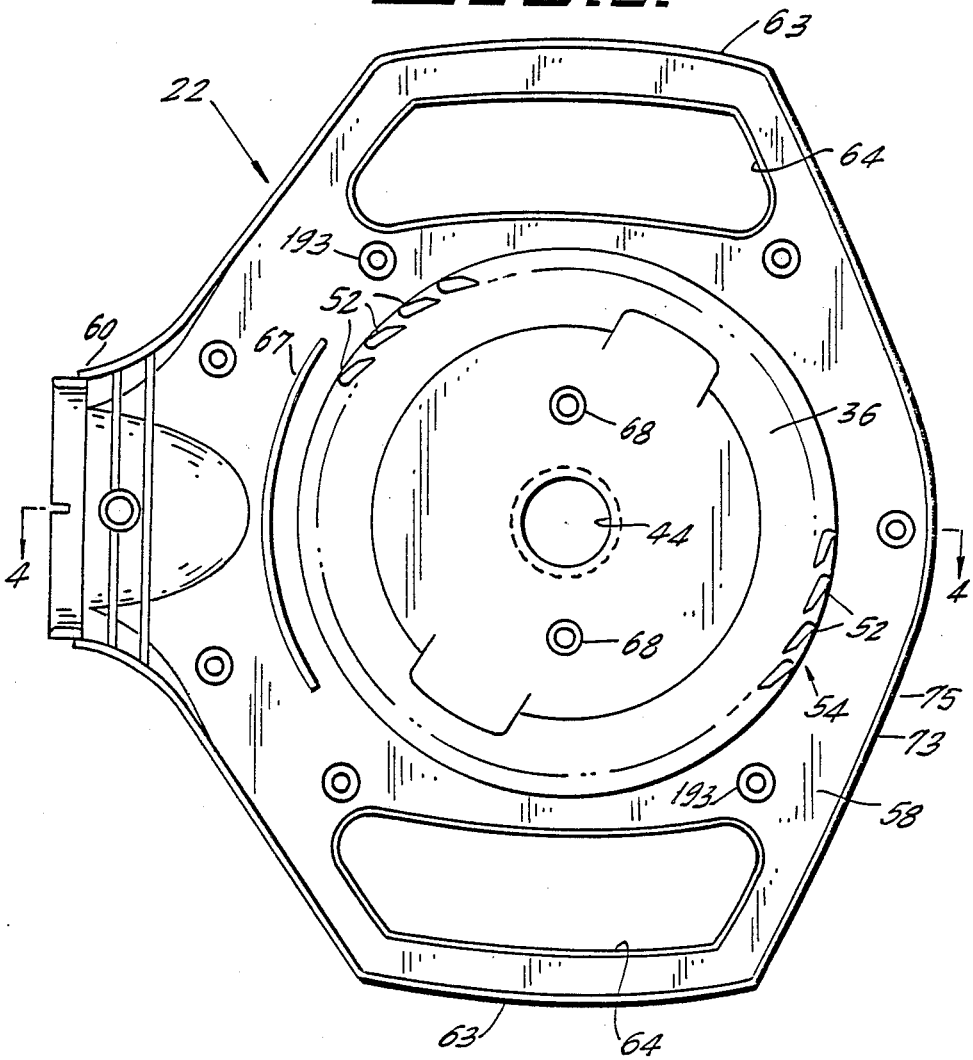
FIG. 5 is a bottom view of the upper blower housing.

FIGS. 1–3 of the first embodiment of the blower 20 shows that the blower generally is comprised of an external housing, including an upper blower housing 22 which extends up towards the motor cap 230 above it down to the lower bearing 216 of the blower motor 210, and a lower blower housing 24 beneath the upper housing which extends beneath the blower fan 220 and the motor cap 230 over the motor 210. The blower further includes the intake shield 120 beneath the lower blower housing 24. There is an adapter 140 beneath the intake shield 120 to which the blower 20 is separably and also adjustably attached for attaching the blower to a surface like the lid 180 of a vacuum cleaner 21.

The electric motor 210 drives the centrifugal fan 220 to rotate. The fan draws air through the inlet opening 146 of the adapter 140 when the blower is seated on a lid 180, through the air passages 126 through the intake shield 120, through the inlet 86 in the bottom 84 of the lower blower housing 24, through the centrifugal fan 220, around the chamber 244 in the lower blower housing 24, through the plenum 54 in the upper blower housing 22 and out the blower outlet 61.

These features of the blower 20 are now more specifically described.

In FIG. 1, the region of the blower at the lower right in the Figure is not in the plane of the cross sectional view of FIG. 1, but rather is rotated 90° from that plane. FIG. 1 appears in this way for more clearly illustrating the complete assembly of the blower.

The upper blower housing 22 and the lower blower housing 24 sealingly meet at the seal line 26 extending around the entire housing into the upper blower housing 22 as well.

The upper housing 22 is shown in FIGS. 1, 3, 4 and 5. It includes an annular top edge 32 that is sealingly received in the lower end of the motor cap flange 236. An annular sidewall 34 defines the sidewall of the chamber 238 in which the blower motor 210 is disposed. Beneath the sidewall 34, the bottom of the upper housing 22 is defined by the annular outer portion 36 which extends in from the sidewall to the depressed cup portion 38. In the cup 38 are defined a plurality of fins 42 with inclined top edges 43 which together define a seat for the bottom 214 of the housing of the motor 210.

The cup 38 has a central opening 44 surrounded by an upstanding collar 46 which receives the lower bearing 216 of the motor 210 and seals around it, essentially preventing air flow past the floor 36, 38 of the upper housing 22 and into the chamber 238 in which the motor 210 is disposed.

Depending down from the annular portion 36 of the floor outward of the cup 38 are a plurality of vanes 52 which are each oriented obliquely to the circle of the array of vanes. Such vanes are conventionally used in centrifugal fan arrangements, as in vacuum cleaners, for directing the exit air flow from the centrifugal fan to circulate around outside the vane array. Outward of the sidewall 34 and the bottom 36 of the chamber 238 for the motor, the upper housing defines the an open annular plenum 54. The plenum is open around the entire peripheral wall 34 so that air can circulate completely around the array 52 of vanes. Outward of the peripheral wall 34, the upper housing has an upper wall 58 which encloses and defines the upper side of the plenum 54.

At one side of the upper housing 22 is defined a semicylinder, partial tube, outlet section 60 which cooperates with the semicylinder outlet section 76 of the lower housing 24 to define the blower outlet 61 from the plenum 54.

An arcuate wall 67 projects down from the upper wall 58 of the housing and just inside the opening at the outlet section 60 for preventing a user's hands or foreign articles from moving directly into the upper housing.

At two opposite sides 63 of the upper housing 22, the housing is widened and shaped to define the hand grip openings 64 which cooperates with similarly placed hand grip openings 78 on the lower housing 24. The blower is attached to and removed from a lid 180 by rotating the blower, for example, and the hand grips 64 enable the operator to rotate the blower housing. They also provide means for easily carrying the portable blower. Two hand grips 64 are provided for providing maximum versatility in holding the blower and in directing the outlet 61 from the blower in any orientation and direction.

The upper housing has a pair of short height bosses 68 beneath it in which are disposed the heads of screws 69 which hold the motor 210 to the upper blower housing.

Figure 7:
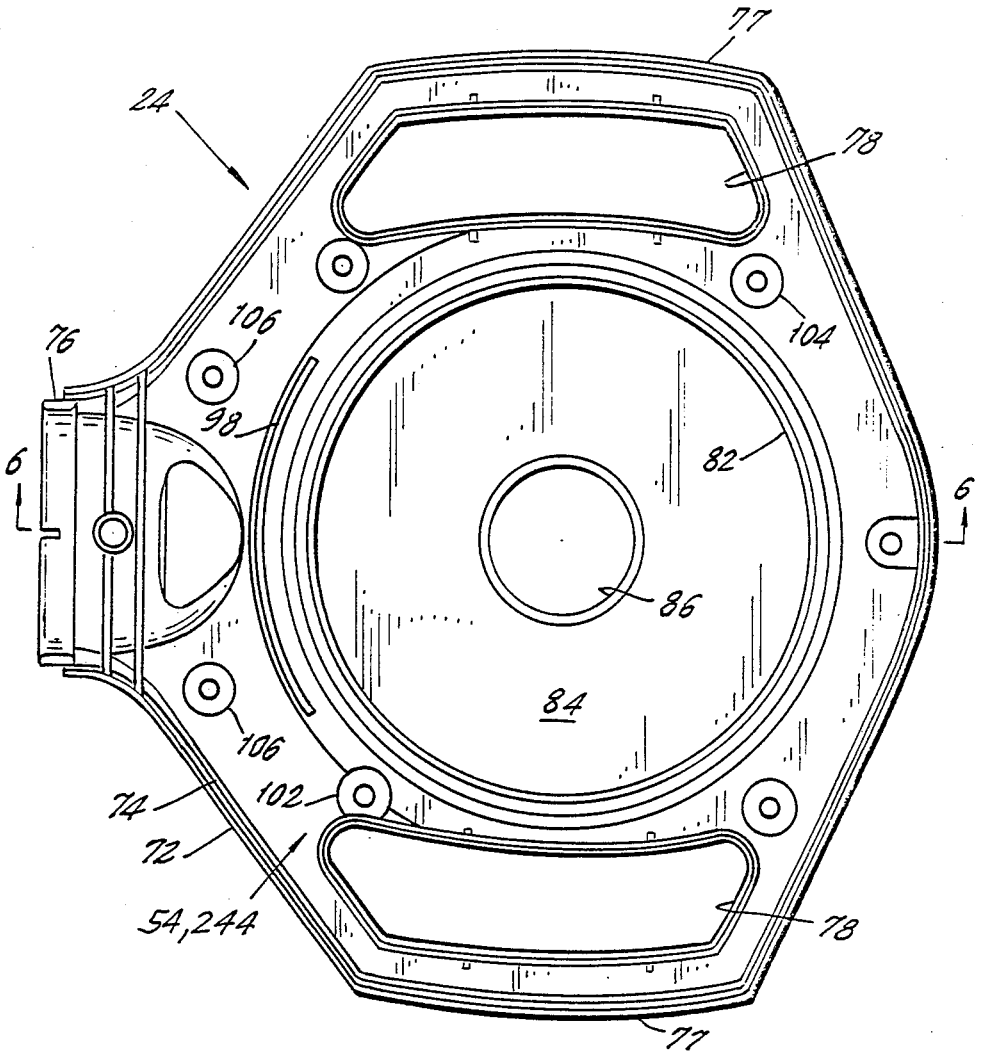
FIG. 7 is a top view of the lower blower housing.
Figure 6:
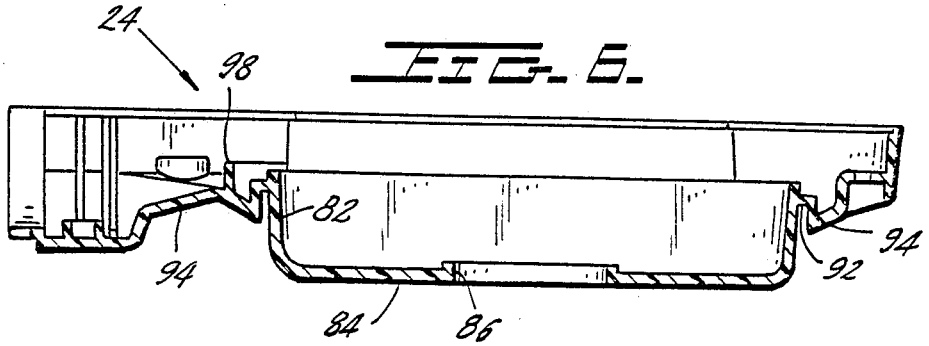
FIG. 6 is a side cross sectional view of the lower blower housing of the blower, viewed along the line 6—6 in FIG. 7.

The lower blower housing 24 in FIGS. 6 and 7 is open topped to mate with the open bottom of the upper housing 22. The lower housing has the same external profile 72 as the profile 73 of the upper housing, and the upper and lower housings meet at the respective profiled engagement edges 74 on the lower housing and 75 on the upper housing to be secured together. In this way, the upper and lower housings together define the plenum 54, 244.

At a position corresponding to the position around the upper housing of the outlet section 60, the lower housing has a respective semicylinder, partial tube, outlet section 76 which cooperates with the outlet section 60 to define a complete cylindrical outlet 61 from the plenum 54. The wide opposite sides 77 of the lower housing are shaped to define and complete the openings 78 for the hand grips of the entire blower housing when it is assembled.

The lower housing defines a cup like chamber in which the centrifugal fan 220 is disposed. That chamber has the annular wall 82 which surrounds and supports the annular floor 84 which is disposed beneath the fan. At the center of the floor 84 is an inlet opening 86 for air to flow to the underside of the centrifugal fan 220. Outward of the annular wall 82, the lower housing has an annular slot 92 into which the periphery 122 of the intake shield 120 is spin welded. Radially further outward, the underside of the lower housing at 94 is configured to cooperate with the adapter 140 on which the blower is seated.

Inward of the outlet section 76, directly beneath, projection toward and meeting the depending protective wall 67 is the upstanding, arcuate protective wall 98 in the lower housing. The walls 61 and 98 define a barrier against entrance of fingers or objects through the open pathway defined by the semicylinders 60 and 76.

Detent recesses 102 and 104 at diametrically opposite positions around the lower blower housing 24 establish the orientation of the blower with respect to the lid 180, as is described below. Screw holes 106 around the lower housing cooperate with corresponding openings 193 in the upper housing for receiving screws for securing the housings together.

To complete the outlet cylinder 61, a ferrule 110 has a body 112 that extends into the semicylinders 60 and 76 and includes end clamping slot 114 which clamps the outer ends of the outlet sections 60, 76, thereby forming the unitary outlet 61 from the blower housing.

Figure 9:
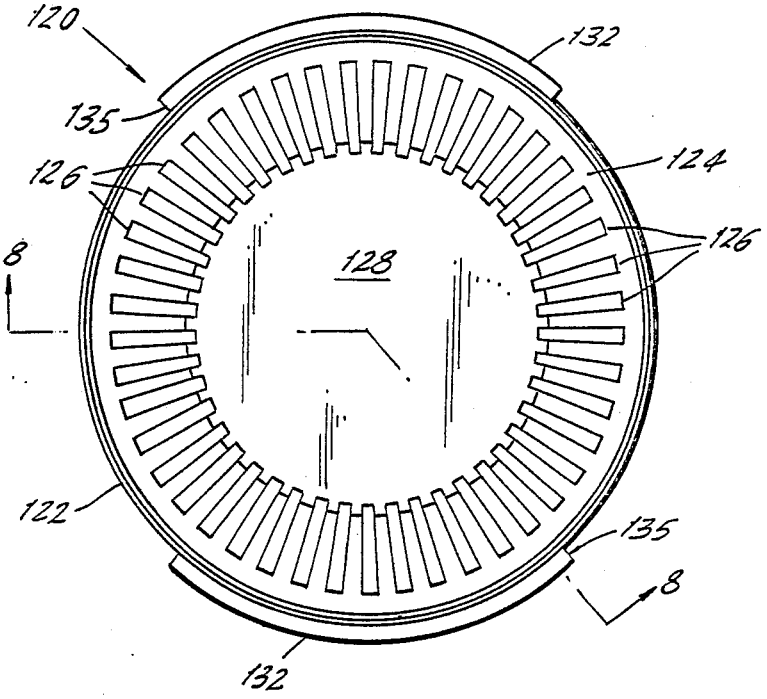
FIG. 9 is a top view of the intake shield.
Figure 8:
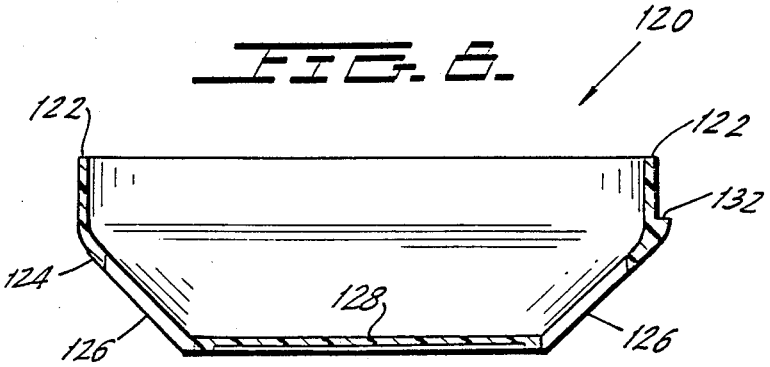
FIG. 8 is a side cross sectional view of the intake shield of the blower, viewed along the path indicated by the arrows 8 in FIG. 9.

Beneath the lower housing 24 is disposed an intake shield 120 shown in FIGS. 8 and 9. It is generally cup shaped. Its upper annular periphery 122 is installed in and spin welded into the annular groove 92 at the underside of the lower blower housing 24, so that the intake shield is integrated with the lower housing 24. This avoids air leakage past the edge of the intake shield 120. The shield has an inclined peripheral wall 124 in which is defined a grill of narrow width air passage openings 126 for permitting entrance of air to the inlet 86 into the lower housing 24. The grill openings 126 are narrowed to prevent the entrance of fingers or articles through the grill 126 when the blower 20 is separated from the lid 180. When the blower is separated, shield 120 serves as one exposed side of the blower. The intake shield 120 has a generally flat bottom 128. The grill openings 126 are not primarily in that surface 128. If the blower is operated while the flat bottom 128 of its intake shield is on a surface or is resting against the person carrying and using the blower, this contact will not interfere with the inflow of air through the grill openings 126, and the user's clothing, for example, would not be undesirably pulled into the grill openings 126.

Two arcuate flanges 132 extend part way around the intake shield 120. The flanges 132 together underlie and define a bayonet type locking arrangement with cooperating flanges 166 in the adapter 140. This enables the intake shield and the entire blower housing to be held securely to the lid 180. The ends 135 of the flanges 132 meet the blocking walls 167 at the ends of the adapter flanges 166 when it is attempted to rotate the blower housing counterclockwise.

An adapter 140 shown in FIGS. 10 and 11 is disposed between the intake shield 120 and the lid 180. The adapter 140 includes the bottom cover 142 which is generally cup shaped and extends far enough into the lid to define a plenum 144 between the cover 142 and the intake shield 120 above it. There is an inlet opening 146 through the floor 142 of the cover for air to enter the blower when the ball float 148, which is supported in the standard ball float support cage 186 of the lid 180, is down, out of the opening 146. The adapter extends to its peripheral flange 152 which has opposite wide, rounded sections 154 and narrower sections 156. The flange 152 extends up to and seats securely against the edge 162 of the opening into the lid 180 in which the adapter 140 is disposed to effect a vacuum seal.

There is a vacuum seal at 164 between the intake shield 120 and the adapter 140 which prevents loss of vacuum from the plenum 144 above the adapter 140 and from the space 121 above the intake shield 120. The vacuum that develops when the motor 210 is operating draws the adapter 140 up toward the blower housing 20 which effects the two seals at 162 and 164.

The adapter 140 has at opposite sides a respective pair of arcuate inwardly directed flanges 166 for overhanging the cooperating flanges 132 on the intake shield 120. As seen in FIG. 10, the adapter peripheral flange 152 is tall. The flanges 166 are at two arcuate positions around the narrowed width regions 156 of the flange 152. At one end of each adapter flange 166 is a blocking wall 167 which is abutted by the end 135 of an intake shield flange 132 if it is attempted to engage the flanges 132 and 166 by counterclockwise rotation of the blower. They are engageable only by clockwise rotation and are disengageable only by counterclockwise rotation.

At spaced intervals beneath the flange 152, there are a plurality of hollow, open bottomed bosses 172 for receiving the shanks of respective screws 174 which are screwed through respective holes 184 in the top 182 of the lid 180 and into the interior of the bosses 172, thereby securing the adapter 140 to the lid, so that the blower at its intake shield 120 may be separated from the tank lid 180 while the adapter 140 remains with the lid.

When the blower housing 20 is in one rotative position, the flanges 132 and 166 overhang one another, as shown in FIG. 1, and this prevents raising of the blower from the adapter. When the blower is rotated counterclockwise 90° from the flange overlapping condition, the flanges 166 no longer overhang the flanges 132, which frees the blower for being lifted off the adapter.

The lid 180, shown in FIGS. 1 and 2, is for a tank type vacuum cleaner. The lid is removably secured to the tank 188 in conventional fashion. The tank has a suction inlet 191. The lid has a top surface 182 with holes 184 through it at locations aligned with the bosses 172 in the adapter. Screws 174 pass through the holes 184 in the lid and are screwed into the bosses 172 to secure the adapter to the top of the lid.

As is known from U.S. Pat. No. 4,185,974, the lid has an integral lid cage 186 depending beneath it which encloses the above described float ball 148 and which also defines a support for a standard annular filter 189 that is placed over the lid cage prior to operation of the unit in order to filter air being sucked out of the tank 188.

The blower housing 20, together with the motor 210 and the intake shield 120 are held to the adapter 140 and the lid 180 by the above described cooperation of the flanges 132 and 166. A releasable spring latch arrangement 190 shown in FIGS. 11–14 holds them in one of two locked together rotative orientations. The adapter supports a single latching arrangement 190 in opening 194.

The lower blower housing 24 has at its underside (FIG. 7) the two diametrically opposite openings 102 and 104 which cooperate with the arrangement 190 so that the blower outlet may face in either of two opposite directions. The recesses at 102, 104 are depressed into the bottom of the lower housing to define respective receptacles for the detent latching button 198, described below. The bottoms of the recesses 102, 104 have holes through which pass screws 192 which join the lower housing 24 into bosses 193 of the upper housing. Screws also pass through the other holes 106 in the lower housing into receiving bosses in the upper housing.

Referring to FIG. 12, the releasable latching arrangement 190 is held between the top 182 and the adapter 140. There is an opening 194 in the bottom of the adapter which guides the detent buttom 198 for vertical movement into the recess 104. The detent button 198 is biased upwardly into the recess 104 in the lower housing 24 by the spring 202 which is housed inside the button 198 and presses up upon the button and down against the lid 182. The button 198 includes a molded lateral extension 204, which engages an overhanging flange 206 on the adapter 140 to define the maximum extent of the upward motion of the button 198. When the button 198 is up, it is received in the recess 104 in the lower housing. This holds the blower against rotation and establishes a particular rotative orientation for the blower with respect to the adapter and lid. The diametrically opposite recess 102 may alternatively be the one to receive the button 198 when the blower is rotated 180° from that orientation with the button in recess 104. The recesses 102 and 104 are placed so that with the button 198 disposed in either recess 102 and recess 104 in the lower housing, the flanges 132, 166 are completely overlapped, for holding the blower to the lid.

The extension 204 on the button 198 is a manually operable button which may be depressed by the user to release the locking connection between the adapter 140 and the lower housing 24. Once this connection is released, the lower housing and thus the entire blower 20 can be rotated with the hand grips 64, 78 until the cooperating overhanging flanges 132, 166 have moved so that they no longer overhang, which enables the blower to be lifted out of the adapter.

This embodiment of a blower employs a conventional electric blower motor 210. That motor has one exterranl fan 220 for the blower air and a second internal fan, not shown, for cooling the motor. The motor is seated on the inclined edges 43 of the plurality of fins 42 in the upper housing 22. The motor 210 includes its own lower housing 212 with a conically shaped lower wall 214 which seats on the edges 43 of the fins. The motor shaft 218 is supported in a lower bearing 216, the exterior of which is held in the opening 44 at the bottom of the upper housing. The motor shaft 218 is secured to and drives the conventional centrifugal fan 220 to rotate in the chamber 244 in the lower housing. The manually operable electric switch 222 at the exterior of the motor cap is operated to turn on the motor to drive the fan. Atop the motor is a motor cover 223 which closes the motor and also holds the motor in place inside the motor cover.

External to the motor 210 is the enclosing motor cap 230 which covers over the top end of the motor including the upper bearing 232 for the motor shaft 218. The top 231 of the motor cap is essentially closed, so that if the motor cap rests on a surface or presses against the clothing of a person who carries the blower, air is not blocked from entering the cap through the cooling air inflow vents 233 on the side of the cap and near the top. The cap extends down along its side wall 234 to its peripheral flange 236 which wraps over and substantially seals to the flange 32 at the top of the upper blower housing 22. In known manner, this creates an enclosed cooling air outlet plenum 238 for the cooling air that has passed through and then exited from the motor 210. The exhausted cooling air exits through other vents from the plenum 238. The plenum 238 is separated by the closed bottom 36, 38 of the upper housing 22 from the main air pathway through the blower. The motor and motor cap described above is further detailed in applicant's U.S. application Ser. No. 940,576, filed Dec. 12, 1986.

The main pathway of air through the blower is from the exterior of the blower, which may be the interior of the tank 188 if the blower is on the tank, or otherwise from the ambient, through the sealable opening 146 in the bottom of the adapter 140, through the plenum 144 between the adapter and the intake shield 120, through the passage openings 126 in the side wall 124 of the intake shield through the chamber 121 above the intake shield 120, through the entrance 86 in the bottom 84 of the lower housing, axially into and then radially and centrifugally out of the centrifugal fan 220, laterally into the plenum 244 above and around the fan 220 and within the sidewall 82 of the lower housing, past the vanes 52 of the upper housing, beneath the bottom 36, 38 and outside the sidewall 34 of the upper housing 22, through the plenum 54, the through the cylindrical outlet 61. With the blower removed from the adapter, air enters the blower through the grill passage openings 126 in the intake shield 120 and then follows the same path.

Figure 15:
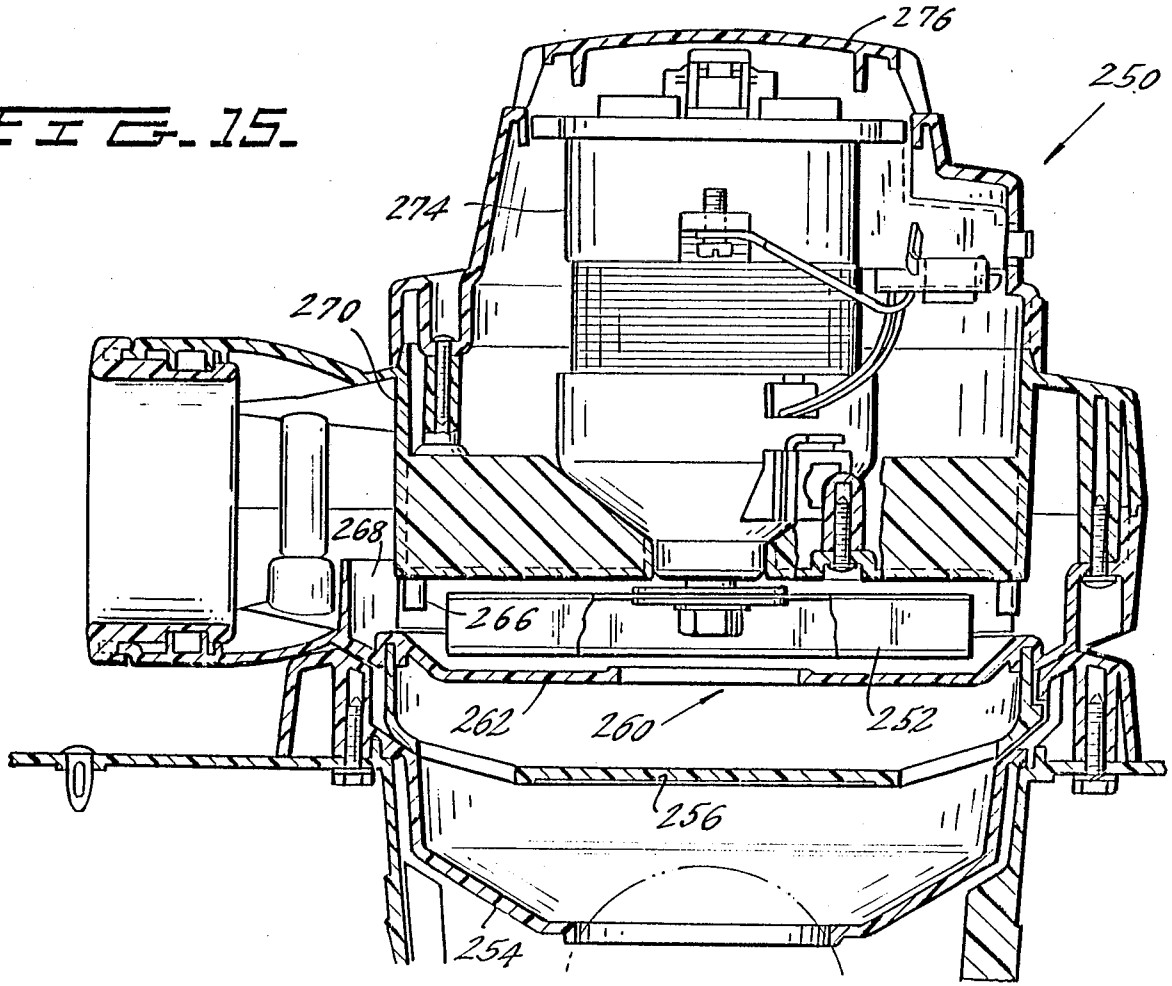
FIG. 15 is a side elevational view of a second embodiment of a blower according to the invention.
Figure 16:
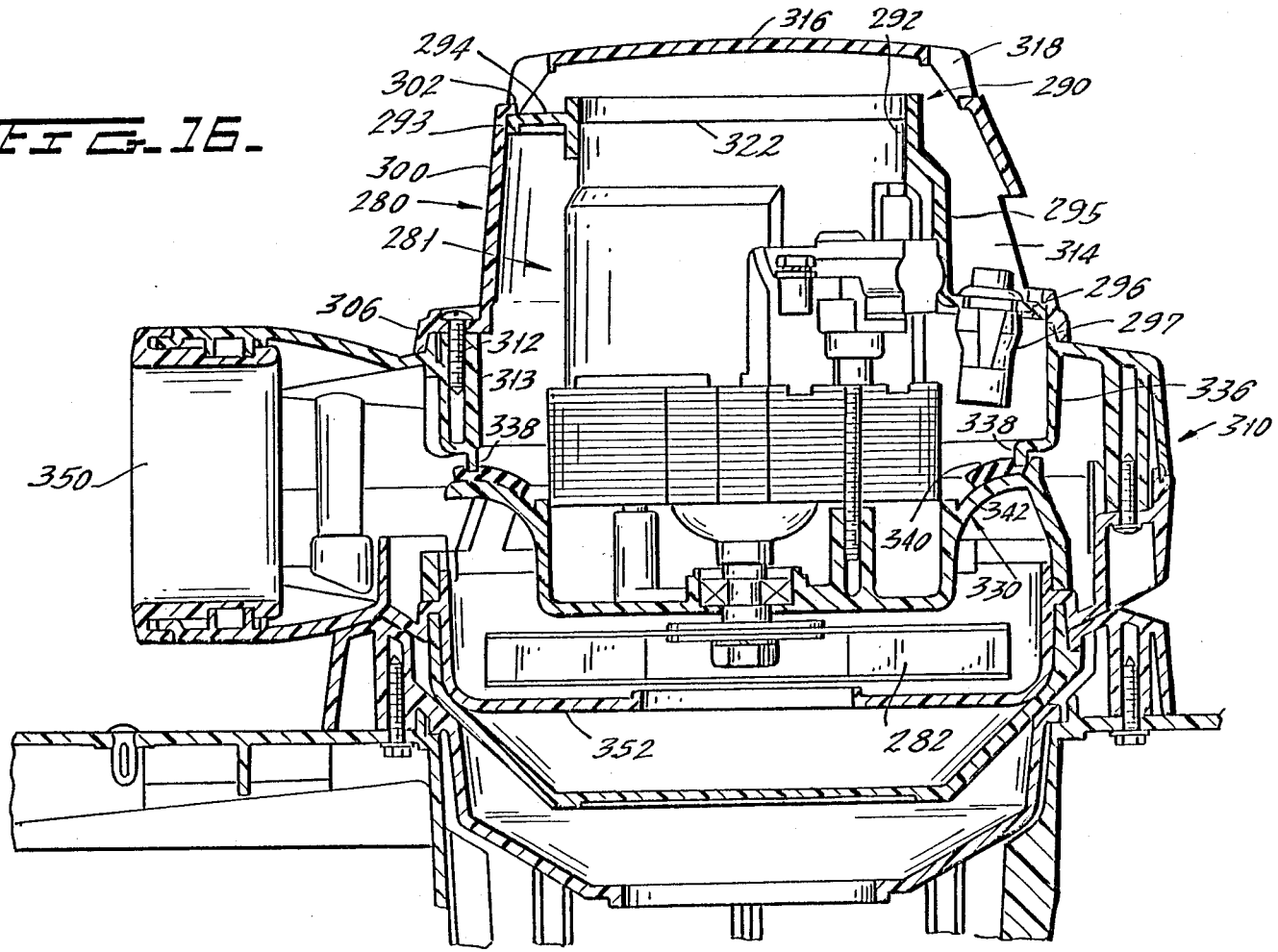
FIG. 16 is a side cross section view of a third embodiment of a blower according to the invention.

A second blower embodiment 250 is shown in FIG. 15. The modification uses a larger size centrifugal fan 252 generating a higher CFM airflow. This, in turn, means that the fan should be raised higher with respect to the blower housing than the fan 220 of the first embodiment. The elements of this second blower are similar to and function similarly to the elements in the first embodiment of the blower and are not described again. The adapter 254 is the same as the adapter in the first embodiment. The intake shield 256 functions similarly to the intake shield of the first embodiment, although it is slightly flatter because the lower blower housing is higher. The lower blower housing 260 is differently shaped from the lower housing 24 of the first embodiment for accommodating the differently shaped upper housing 270 and fan 252. In this embodiment, the lower housing has a bottom 262 which is less depressed than the bottom 84 of the lower housing of the first embodiment, so that there is still only a small clearance between the bottom of the fan 252 and the bottom 262 of the lower housing. In other respects, the lower housing corresponds to the lower housing 24 of the first embodiment and is not further described.

In this embodiment, the air pathway out of the centrifugal fan is through the vanes 266, which, as in the first embodiment, depend beneath the upper housing 270 and then flow is into the chamber 268 which surrounds the vanes 266. The airflow from the centrifugal fan therefore does not first travel up to reach the outlet from the blower, as in the first embodiment.

The upper housing 270 of this embodiment has the features of the upper housing 22 of the first embodiment, except that the upper housing 270 is taller to accommodate the taller motor 274. Similarly, the motor cap 276 is taller to accommodate the taller motor. In other respects, the second embodiment generally is similar to the first embodiment.

FIGS. 16–20 shows a third embodiment of a blower 280 according to the invention. In this embodiment, as contrasted with the first two embodiments, the motor 281 between the motor cap 300 and the upper housing 310 is not itself within its own motor casing. Therefore, various elements, including the motor cap 300 and upper housing 310, cooperate to house and seal the motor in the blower. The motor 281 is a conventional electric motor which is connected with the centrifugal fan 282 for driving the fan to rotate. Around the top of the motor is disposed a baffle 290 shown in FIGS. 17 and 18, which includes an annular ring 292 that extends around the top of the motor and a shelf 294 around the ring, which shelf terminates in its periphery 293 which is shaped to the interior profile of the motor cap 300. Depending from one side of the baffle 290 is a support 295, and outward from the support 295 is the electrical switch support 296 which receives a conventional electrical operating switch 297 that is conventionally wired for operating the blower motor 281.

Figure 19:
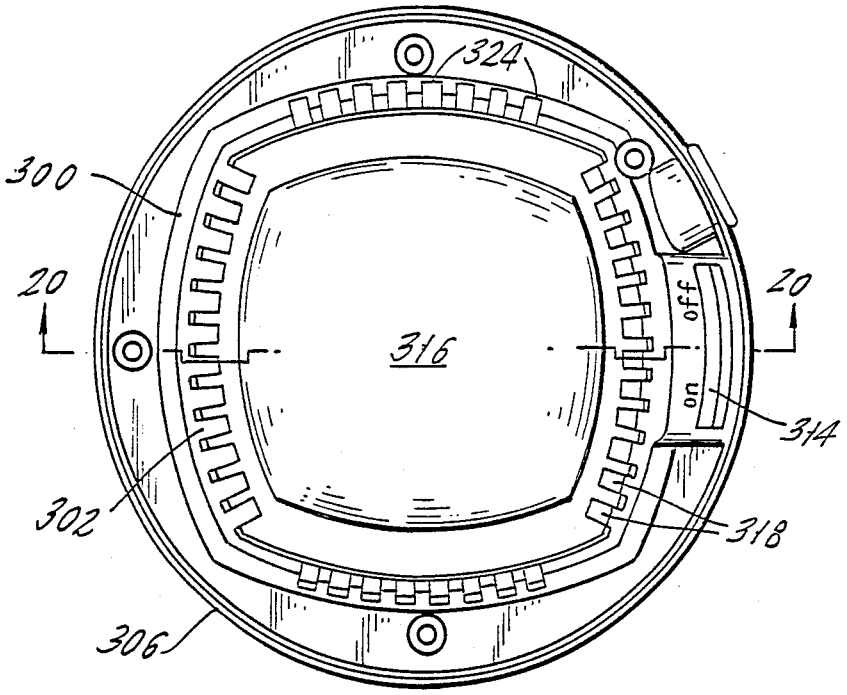
FIG. 19 is a top view of a motor cap for the third embodiment of the invention.
Figure 20:
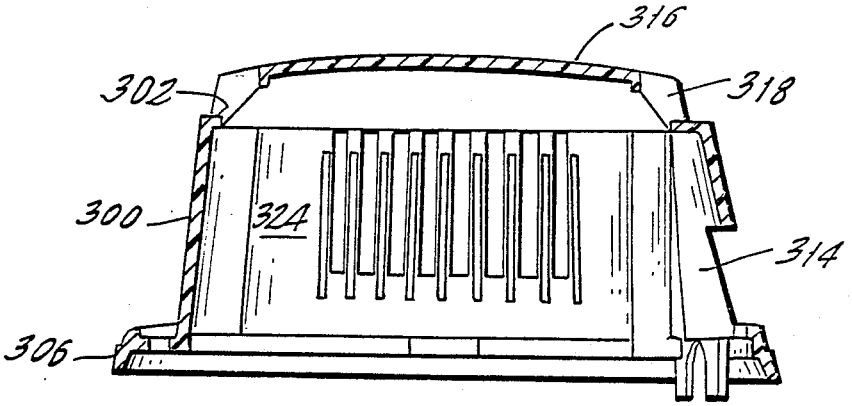
FIG. 20 is a side cross sectional view of the motor cap.

The motor cap 300 shown in FIGS. 19 and 20 is placed around the baffle 290. The cap has an upper peripheral flange 302 which seats on the top of the baffle and positions and also presses down upon it. The cap 300 extends down to its base periphery 306 which rests on top of the peripheral flange around the upper blower housing 310. Screw connection 312 extends between the motor cap and the upper housing into appropriate bosses 313 defined in the upper housing. At the side of the motor cap where the switch support 296 is found, the motor cap has an opening 314 which is partially covered over from above to provide protection for the switch 297 against water, rain and dirt.

The motor cap 300 has a top 316 with grill like openings 318 which define an air inlet for communication of air through the cooling air inlet 322 at the top of the motor 281. As in the other embodiments, the motor cooling air inlet grill openings 318 open mostly at the lateral sides of the cap 300, rather than at the top 316. If the motor housing side is the side of the blower that is held against the body of the user, the inlet openings 318 for cooling air are not blocked by the user. The cover 300 also has a grill of outlet openings 324 for exhaust cooling air which has passed through the motor. Internal baffles, not shown, inside the motor cap separate the flows through grill openings 318 and 324.

In this third embodiment, two sets of grill openings are illustrated. The motor caps in the other embodiments may also have two sets of grill openings which are separated by appropriate internal baffles within the motor cap, not shown, as this is conventional.

As was noted in previously mentioned pending U.S. application Ser. No. 940,576, which describes a motor and motor cap assembly, removal of the few screws 312 between the motor cap 300 and the upper housing 310 of the blower provides access to the motor 281 and to the motor switch 297 for easy servicing, without requiring removal of any of the other elements. Following removal of the motor cap, the motor 281, the switch 297, the power cords to the switch and motor and the motor brushes, which are all serviceable parts, are exposed to easy access. Then the parts and the motor cap may be simply returned to position and the cap reattached, closing the blower.

Another major difference between this blower embodiment and that in the previous embodiments relates to the separation of the main airflow past the blower fan 282 from the cooling airflow that has passed through the motor. There is here a separate lower motor housing 330 which extends completely around the motor and is inside and above the upper blower housing 310, because the upper blower housing lacks the supports for the motor that are found in the other embodiments. The upper blower housing has a downwardly depending flange 336 which extends entirely around the interior of that housing and includes an annular bottom tab 338 which projects toward the lower motor housing 330. A resilient sealing gasket 340 is disposed between the bottom tab 238 and the curved periphery 342 of the lower motor housing. This provides a separating seal between the cooling air above the lower motor housing 330, which has been exhausted from the motor 281, on the one hand, and the main airflow past the centrifugal fan 282 which is moving through the outlet 350 from the blower, on the other hand. As in the second embodiment, the fan 282 is upraised in the upper housing 310 and the lower housing bottom 352 so that the exit flow of air from the centrifugal fan is essentially more outward, rather than first upward and then outward, as in the first embodiment.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. An air blower, comprising:

an external housing, an air inlet into the housing, an air outlet from the housing, a motor in the housing, a centrifugal fan in the housing having a periphery and connected to be driven by the motor for drawing air into the housing inlet and for blowing air out the housing outlet;

a support located in the housing for supporting the motor and the support being shaped and so disposed in the housing for providing air separation between the motor and the fan;

the housing including a chamber outside the periphery of the centrifugal fan and at the fan side of the support for the motor, and the chamber communicating with the outlet from the blower;

the inlet to the housing including an inlet opening through which air is drawn into the housing and the fan being disposed near the inlet opening;

an intake shield sealingly attached to the housing and extending past the inlet to the housing; where the intake shield extends past the inlet opening, the intake shield being spaced from the housing and from the housing inlet; and air passage means through the intake shield for enabling air to be drawn past the intake shield and into the housing inlet;

said intake shield serving as an external surface of the housing shaped and disposed so that the entire blower may be sealed upon the intake shield external surface; the air passage means on the intake shield being generally off the intake shield external surface so as not to be blocked if the intake shield surface is against another or supporting surface;

said external housing further including a blower housing having therein the air inlet and air outlet of the external housing;

said blower housing comprising separate upper and lower portions which are held together, the lower portion being attached to the intake shield, and the support for the motor being part of the upper portion of the blower housing;

each of said upper and lower portions of the blower housing having a first cooperating section, which cooperating sections constitute sidewall sections that are combined to define said air outlet; and each of said upper and lower portions of the blower housing having a second cooperating section, which second cooperating sections define a chamber wherein said fan is disposed.

2. The blower of claim 1, wherein the external housing includes a motor cap for covering over the motor inside the external housing, the upper portion of the blower housing being attached to the motor cap, and the blower housing being disposed between the motor cap and the intake shield.

3. The blower of claim 2, wherein the motor cap includes means therein for supporting the part of the motor toward the motor cap; and the support for the motor at the upper portion of the blower housing includes means for engaging the motor near the fan.

4. The blower of claim 2, wherein the outlet from the housing is generally tubular and is defined by the first cooperating sections that include a first partially tubular section extending out of the upper portion of the blower housing and a second partially tubular section extending out of the lower portion of the blower housing, and the first and second partially tubular sections being combined to define a complete tubular outlet from the housing chamber.

5. The blower of claim 1, further comprising:

a support for the housing and the intake shield, the support comprising a surface having an opening in it and the opening being defined by a periphery around the opening in the surface, the intake shield being disposed over the opening in the surface and partially extending into the opening, and an adapter disposed in the opening in the surface, covering the periphery of the opening in the surface and supported to the surface, and the adapter also receiving in it the intake shield and being spaced from the air passage means of the intake shield; a generally air sealing connection between the adapter and the surface at the periphery of the opening, on the one hand, and between the adapter and the intake shield, on the other hand, and the intake shield being further sealed to the housing;

an inlet opening through the adapter communicating with the space between the adapter and the intake shield for defining an air pathway from the adapter to the intake shield.

6. The blower of claim 5, wherein the external housing has a generally cup shaped bottom in which the housing inlet is located; the intake shield is also generally cup shaped and generally surrounds the cup shaped bottom of the housing, the intake shield having a top periphery which is bonded to the housing so as to air seal the intake shield to the housing, the intake shield cup shape being such that the intake shield has a bottom that extends past and is spaced from the bottom of the housing;

the adapter also being generally cup shaped, the adapter having an internal periphery which is shaped so that the intake shield rests upon the adapter internal periphery when the blower and the intake shield are on the adapter internal periphery, and the adapter further having a sealing connection with the surface having the opening in which the adapter is disposed.

7. The blower of claim 6, further comprising a tank having an open top, and the surface being disposed over the tank top; the adapter extending across and depending into the tank top and the inlet opening through the adapter communicating into the tank.

8. The blower of claim 5, wherein the inlet opening through the adapter is misaligned from the air passage means through the intake shield and the air passage means is misaligned from the inlet opening to the lower blower housing for creating a tortuous pathway for air travelling through the adapter, the intake shield and the inlet housing and also for preventing articles from moving directly through the adapter into the blower housing.

9. The blower of claim 8, wherein the housing has a bottom surface and the inlet opening is through that bottom surface centered along the axis of the fan; the fan is a centrifugal fan with its axis directed toward the bottom of the housing, and the intake shield has a sidewall between its bottom and its top periphery and the air passage means being defined in the intake shield sidewall, and the adapter having a surface below and spaced from the bottom of the intake shield, the inlet opening of the adapter being defined in the adapter surface.

* * * * *